US006564513B2

(12) United States Patent
Henbid et al.

(10) Patent No.: US 6,564,513 B2
(45) Date of Patent: May 20, 2003

(54) EXTRUSION DESIGN AND FABRIC INSTALLATION METHOD FOR WEATHER TIGHT SEAL

(75) Inventors: Rick Henbid, Saskatoon (CA); Greg Parsons, Saskatoon (CA); Wayne Rendely, Huntington Station, NY (US); Maurice Van Nes, Saskatoon (CA)

(73) Assignee: Cover-All Building Systems, Inc. (CA)

( * ) Notice: Subject to any disclaimer, the term of this patent is extended or adjusted under 35 U.S.C. 154(b) by 0 days.

(21) Appl. No.: 09/785,894

(22) Filed: Feb. 16, 2001

(65) Prior Publication Data

US 2001/0023561 A1 Sep. 27, 2001

(30) Foreign Application Priority Data

Feb. 16, 2000 (CA) ..... 2298728

(51) Int. Cl.[7] ..... E04B 1/32

(52) U.S. Cl. ..... 52/86; 52/63; 52/222; 52/273; 160/394; 160/397

(58) Field of Search ..... 52/86, 63, 222, 52/273; 160/394, 397

(56) References Cited

U.S. PATENT DOCUMENTS

| | | | | | |
|---|---|---|---|---|---|
| 3,283,462 | A | | 11/1966 | Gregoire | |
| 3,909,994 | A | | 10/1975 | Richter | |
| 3,953,955 | A | | 5/1976 | Huddle | |
| 3,987,835 | A | * | 10/1976 | Bloomfield | 160/397 |
| 4,075,811 | A | | 2/1978 | Keith | |
| 4,214,407 | A | | 7/1980 | Charter | |
| 4,583,331 | A | * | 4/1986 | Hunt et al. | 52/63 |
| 4,665,670 | A | * | 5/1987 | van den Burg | 160/394 |
| 4,838,294 | A | | 6/1989 | Hunt | |
| 5,094,043 | A | | 3/1992 | Ristow | |
| 5,269,106 | A | * | 12/1993 | Stafford et al. | 52/63 |
| 5,953,875 | A | * | 9/1999 | Harkins | 52/86 |
| 6,026,613 | A | * | 2/2000 | Quiring et al. | 52/86 |

* cited by examiner

*Primary Examiner*—Carl D. Friedman
*Assistant Examiner*—Nahid Amiri
(74) *Attorney, Agent, or Firm*—Killworth, Gottman, Hagan & Schaeff, L.L.P.

(57) ABSTRACT

The invention relates to building structures of the type comprising arched frame members supporting panels of flexible materials such as weather resistant fabric. Problems accompanying the use of separate panels extending between frame members are overcome by providing connecting members on the frame members, and panels having means for attachment to the connecting members and flaps of flexible material adjacent to but spaced from the side margins of the panels, the connecting members slidably engage the means for attachment and have a channel to receive the flaps. The flaps are secured in the channel to provide weatherproof connections between the panels.

20 Claims, 7 Drawing Sheets

EXTRUSION DESIGN AND FABRIC INSTALLATION METHOD FOR WEATHER TIGHT SEAL

FIELD OF INVENTION

The present invention relates to a building structure of the type comprising arches supporting flexible material such as fabric.

BACKGROUND OF THE INVENTION

There is an increasing demand for comparatively inexpensive building structures in which arch frame members support a flexible material such as fabric. Such structures can be pre-engineered and are capable of being dismantled and re-erected in different locations. Clear span widths typically range from 30 to 160 feet. There is no limit to the length of the building when the construction is modular.

One approach has been to cover the frame with a single sheet of fabric, such as plastic film or sheeting. Building of this type are illustrated in U.S. Pat. No. 6,026,613. However, it is difficult to position a single sheet of fabric in the case of a large structure. If there is damage, any repair is usually of a patchwork nature because of the cost of replacing the entire fabric. It is generally impossible to replace small sections. Also, a single sheet is not adaptable to a modular approach.

The problems of a single sheet can be overcome by providing panels of fabric which extend between, and are connected to, the arch members of such a building. It is then easier and cheaper to install the fabric. A damaged panel can be replaced in its entirety. The use of separate panels is particularly well-adapted to modular design. There is, therefore, flexibility of design and no limit to the length of the structure, whereas a single sheet structure of considerable length would be impractical or impossible.

There are, however, problems accompanying the use of separate panels. It is difficult to combine ease of installation with weatherproof junctions between the panel. The object of this invention is to address these problems.

SUMMARY OF THE INVENTION

This invention comprises a novel building structure made up of novel connecting members and novel panels.

In one aspect, therefore, there is provided a building structure comprising:

a. a plurality of arch members.

b. panels connected between said arch members, each of the panels comprising a sheet of flexible material having means for attachment at each side margin and a flap of flexible material joined to said sheet adjacent to, but spaced from, the side margins of said sheet.

c. connecting members, comprising means for slidably engaging said means for attachment, a channel to receive said flaps and means for securing said flaps in the channel.

Another aspect of the invention is the novel connecting member. In this aspect, there are provided connecting members (sometimes called keder strips) for connecting keder ropes at the side edges of flexible panels extending between arch members of a building structure and also for connecting flaps joined to the panels adjacent to, but spaced from the side margins of the sheets. The connecting members comprise oppositely-facing c-shaped sections adapted to slidably engage the keder ropes. An offset web connects the c-shaped sections so that a channel within which the flaps may be secured is defined by central portions of the c-shaped sections and said web.

A further aspect of the invention is the novel sheet panel. In this aspect there is provided a panel to extend between connecting members on arch members of a building structure, said panel comprising a sheet of flexible material, a keder rope secured to each side margin of the sheet and adapted slidably to engage the connecting member and a flap of flexible material joined to said sheet adjacent to, but spaced from the side margins of the sheet, said flaps being adapted to be secured to said connecting members.

BRIEF DESCRIPTION OF THE DRAWINGS

These and other features of the invention will become more apparent from the following description in which reference is made to the appended drawings in which.

DETAILED DESCRIPTION OF PREFERRED EMBODIMENTS OF THE INVENTION

Figure 1:
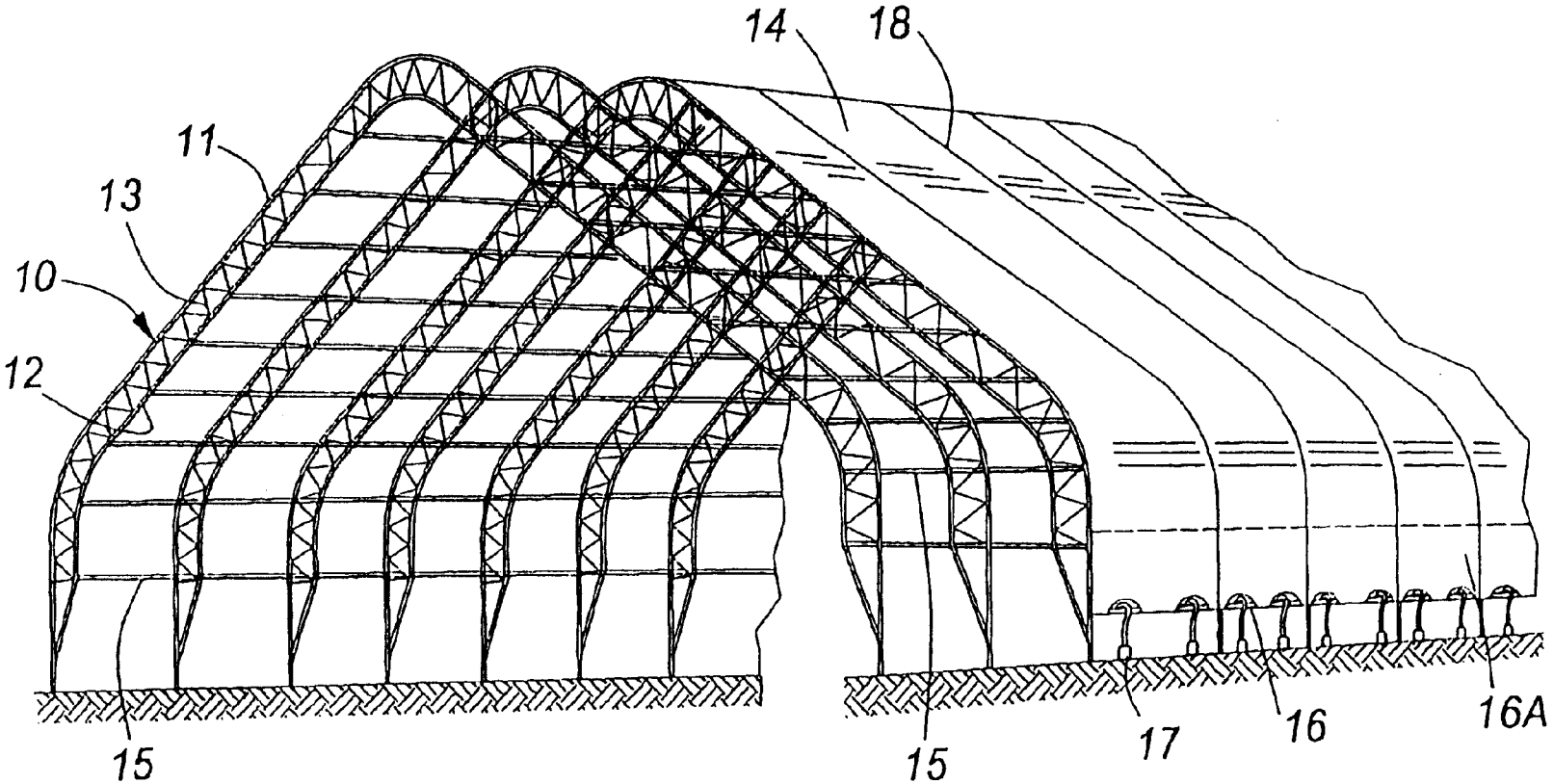
FIG. 1 is an overall perspective view of a building structure showing the supporting arches and panels joined by connecting members.

In FIG. 1 of the drawings, a fabric-covered building is illustrated in perspective comprising truss arch members 10 comprising outer tubular frame member 11, inner tubular frame member 12 and cross braces 13. Truss arch members 10 are preferably of structural steel. Desirably, the arch members are corrosion resistant. FIG. 1 illustrates the building in the course of construction so that some of the truss arch members 10 support and are spanned by panels 14. Inner tubular frame members 12 may be interconnected for stability by horizontal frame members 15. Panels 14 are linear sheets comprised of fabric secured by lateral fasteners and tie down members 16 in pockets 16A at the ends of the sheets of fabric. The fabric may be natural or synthetic, and may be extruded or woven sheets. It is advantageous for the sheets of fabric to be of transparent or translucent woven fiber so that natural light will pass through during daytime. The fabric should preferably be weatherproof and able to sustain tensile loads. Of course, moisture impenetrability and ultra-violet resistance are highly desirable. A suitable woven, tear resistant, weather-proof fabric is available under the trade mark "DURAWEAVE II" from Intertape Polymer Group of Sarasota, Fla. Suitable winches 17 provide tensioning for the panel ends and are disclosed in U.S. Pat. No. 6,145,526 issued Nov. 14, 2000. A suitable winch is available commercially under the trade name WINCH LOCK from Custom Rope & Cable of Saskatoon, Saskatchewan.

Figure 2:
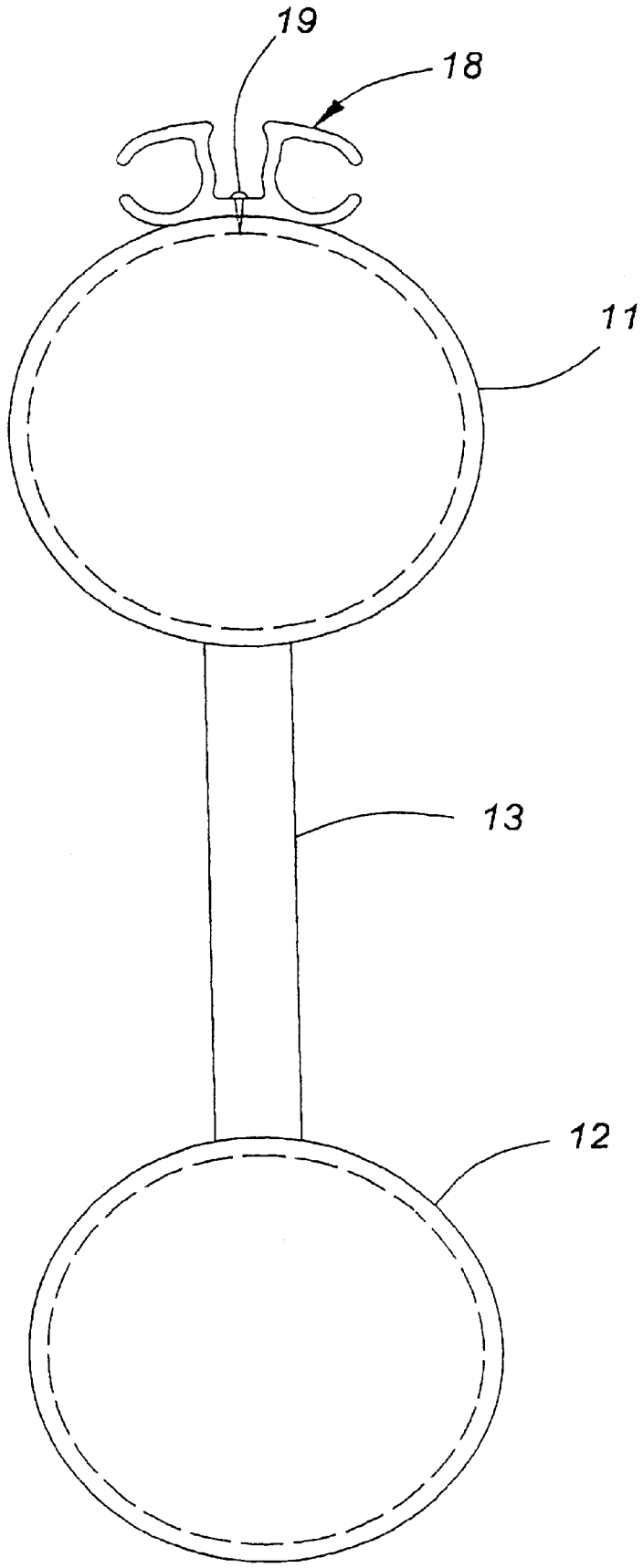
FIG. 2 is a sectional view of a connecting member mounted on an arch frame member.
Figure 3:
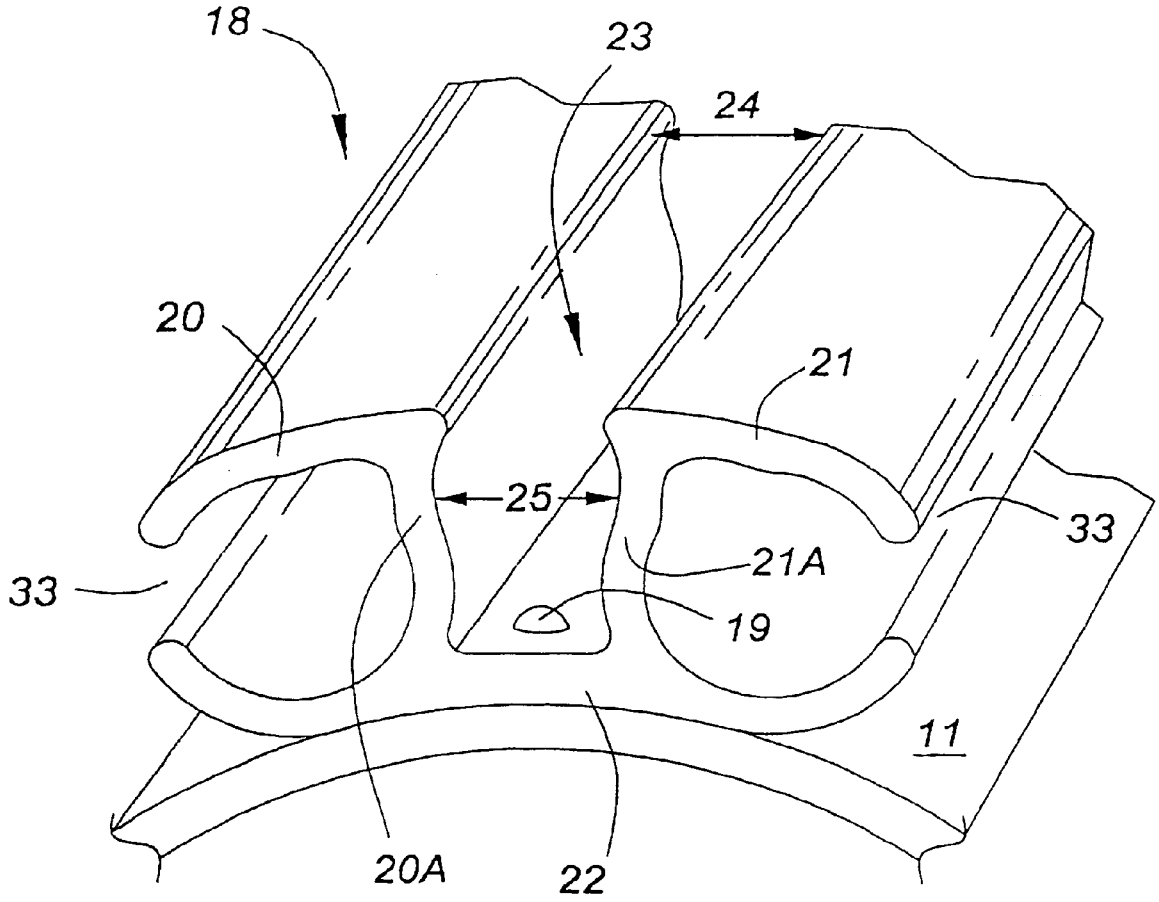
FIG. 3 is a detailed perspective view of the connecting member.

This invention is particularly concerned with connecting member 18, which, as shown in FIG. 2, is a keder strip secured by self-tapping bolts 19 to the outwardly facing surface of outer tubular member 11. As shown in FIG. 3, keder strip or fastening member 18 is an extrusion formed from oppositely facing substantially c-shaped sections 20 and 21 connected by an offset bottom web 22 to leave a channel 23 defined by web 22 and the central portions 20A and 21A of c-shaped sections 20 and 21. Center portions 20A and 21A are concavely curved so that the throat 24 of channel 23 is narrower than the widest part 25. The channel 23 is thus undercut.

Figure 4:
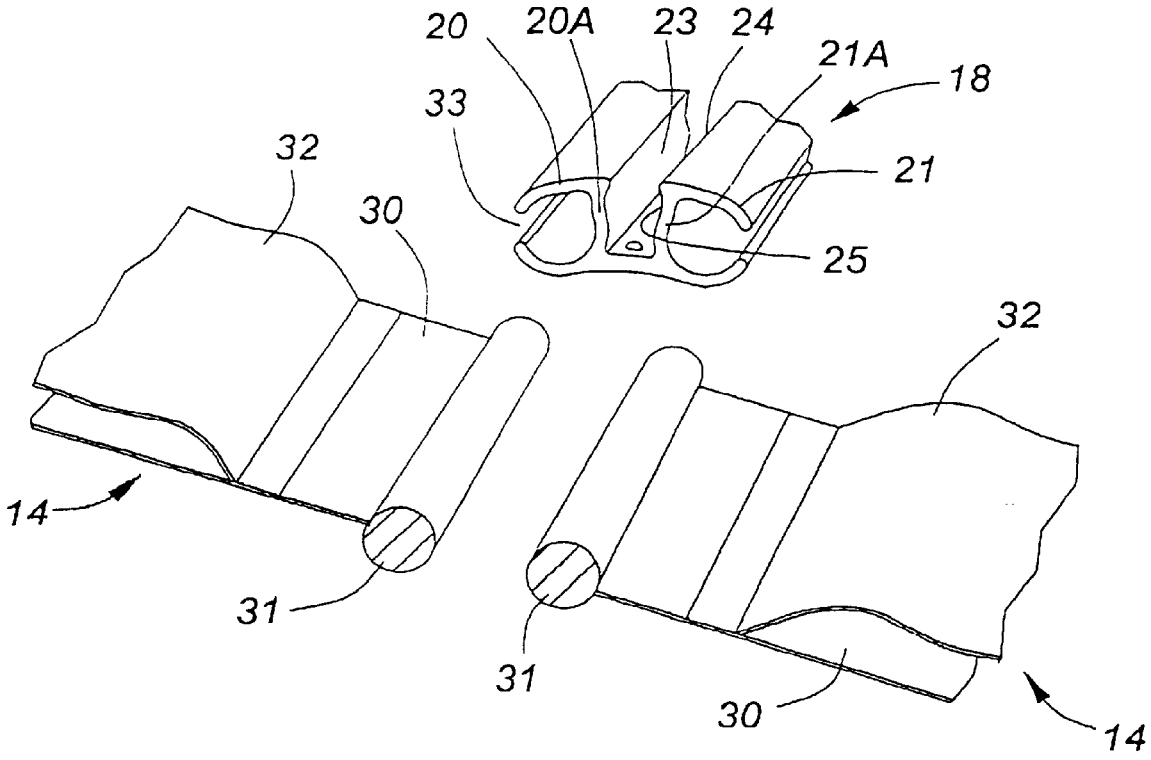
FIG. 4 is a perspective view showing the assembly of the panels and the connecting member.

As shown in FIG. 4, the panels 14 comprise sheets 30 and 30A of fabric with keder ropes 31 and 31A affixed along the sides of sheets 30 and 30A respectively. When the fabric is a plasticized material, the rope may be bonded in a pocket edge of the fabric which is then heat sealed. Spaced from each keder, and heat welded to sheets 30 and 30A, are fabric flaps 32 and 32A. As shown in detail view, FIG. 5, each fabric sheet 30 has keder ropes welded to both margins.

To assemble the structure, keder ropes 31 and 31A, together with integral sheets 30 and 30A, are threaded into c-shaped sections 21 and 20. Keder ropes 31 and 31A are dimensioned to provide a close fit compatible with easy sliding into its desired position. However, the diameter of each keder rope 31 is greater than the width of mouth 33 of the c-shaped sections.

Panels 14 may be tensioned using hold-down members 16 and winches 17 in manner known in the art, and as disclosed in U.S. Pat. No. 6,145,526.

Figure 6:
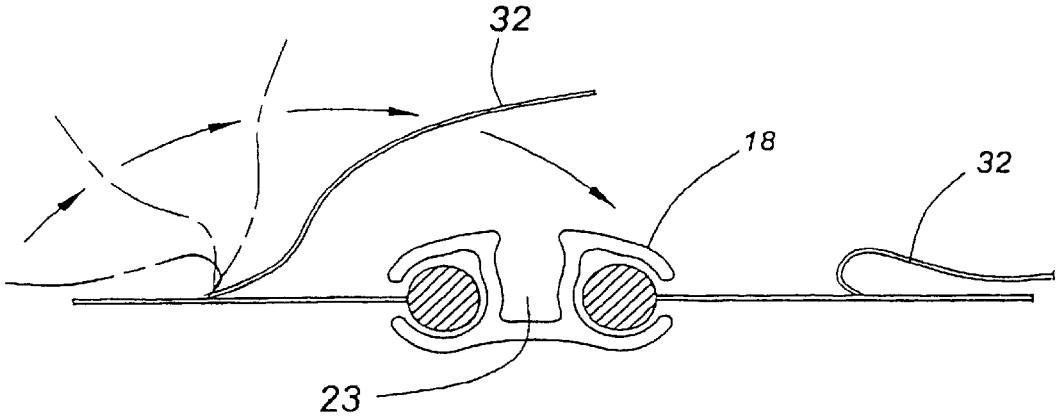
FIGS. 6, 7, 8 and 9 are sectional views showing the sequence of operations in connecting flaps on the panels with the connecting member.
Figure 7:
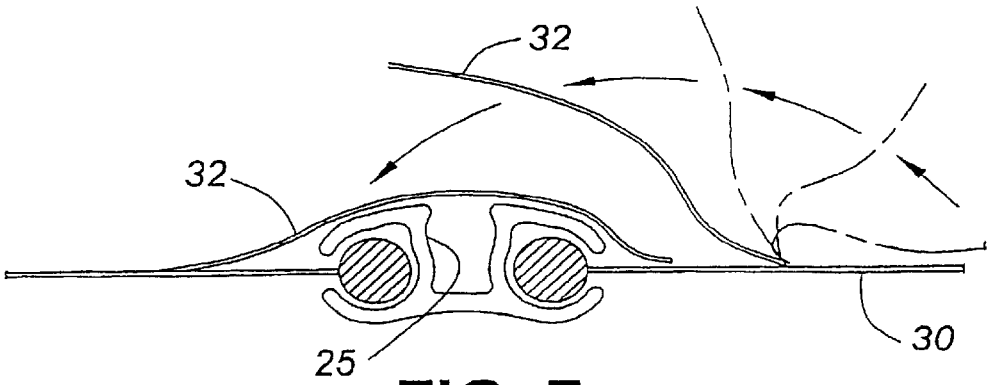
Figure 8:
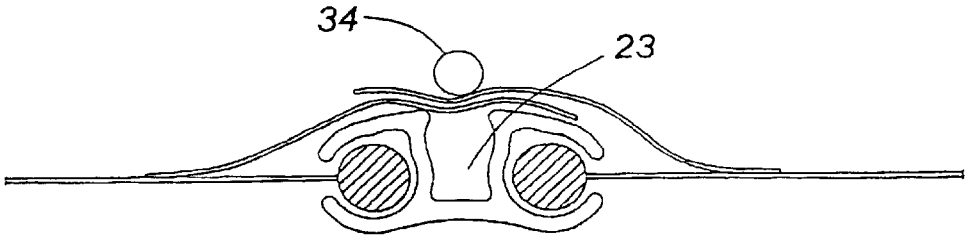
Figure 9:
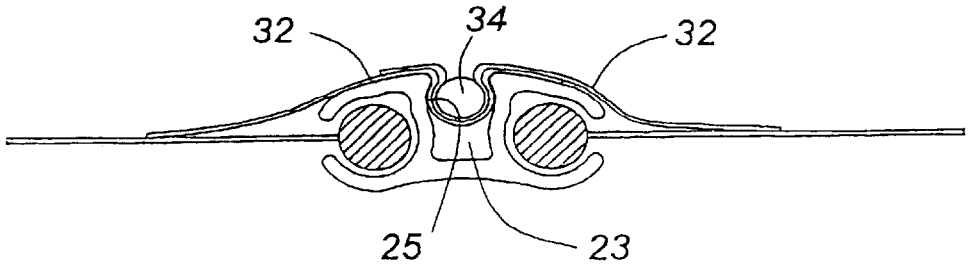

As diagrammatically shown in FIGS. 6 and 7, flap 32A is folded over the top extension of c-shaped section 20 and then flap 32 is similarly folded into place over the top extension of section 21. As shown in FIGS. 8 and 9, an elongated plug such as a round rope plug 34 is forced into channel 23 so that plug 34 is aligned with the wide or undercut portion 25 of channel 23 and holds flaps 32 and 32A in position within the channel 23.

Figure 5:
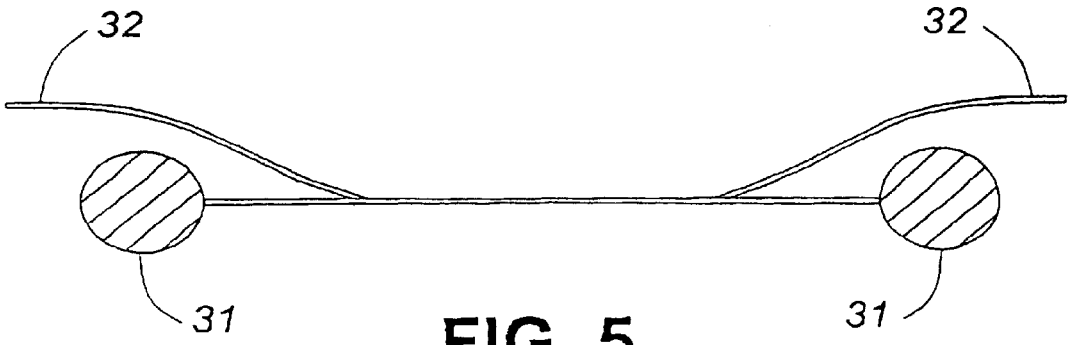
FIG. 5 is a detailed sectional view of a panel.

Roof panel replacement can be achieved by removing rope plug 34 and reversing the steps shown in FIGS. 5 to 7.

Instead of securing fastening members 16 to tubular member 11 and then sliding rope keders 31 into the c-shaped sections 20 and 21, an option is first to mate keders 31 with c-shaped sections 20 and 21 and then to secure fastening member 18 with self-tapping bolts.

There are several ways of positioning rope keders 31 in the c-shaped sections. One option is to pull tie-down member 16 by ropes (not shown) connecting tie-down member 16 to winch 17. Another option is to provide such rope as a direct extension of or attached to the keder rope. The extended rope may be winched by winches 17.

Figure 10:
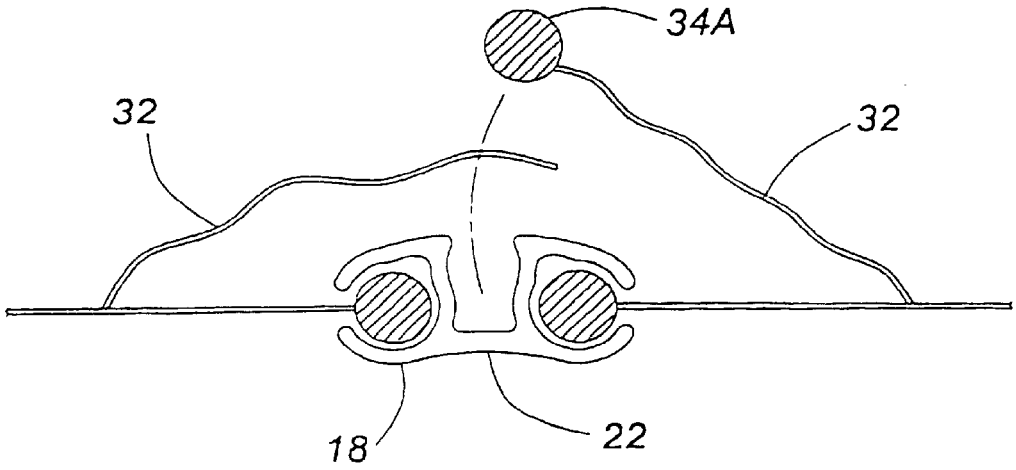
FIG. 10 is a sectional view illustrating an alternate embodiment in which a plug is welded onto one of the flaps.

In one variation, a rope plug 34A could be welded onto one of flaps 32 as illustrated in FIG. 10. It is also noted that plug 34 or 34A could be of various shapes and various materials, provided it performs the function of keeping flaps 32 and 32A in position in fastening member 18.

Figure 11:
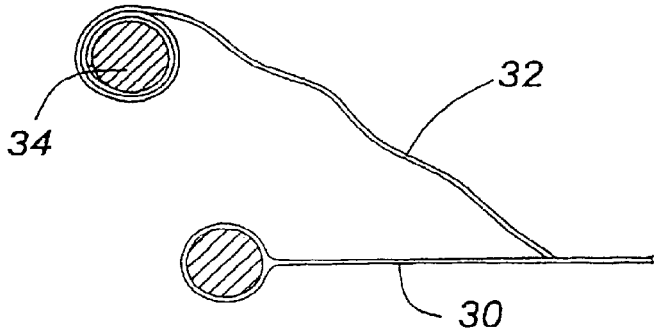
FIG. 11 is a sectional view of an embodiment in which a plug is rolled into a flap.

Another variation is shown in FIG. 11 in which a continuous plug 34 is rolled into fabric flap 32 before it is forced or locked into position over flap 32A in channel 23 of the fastening member 18.

Figure 12:
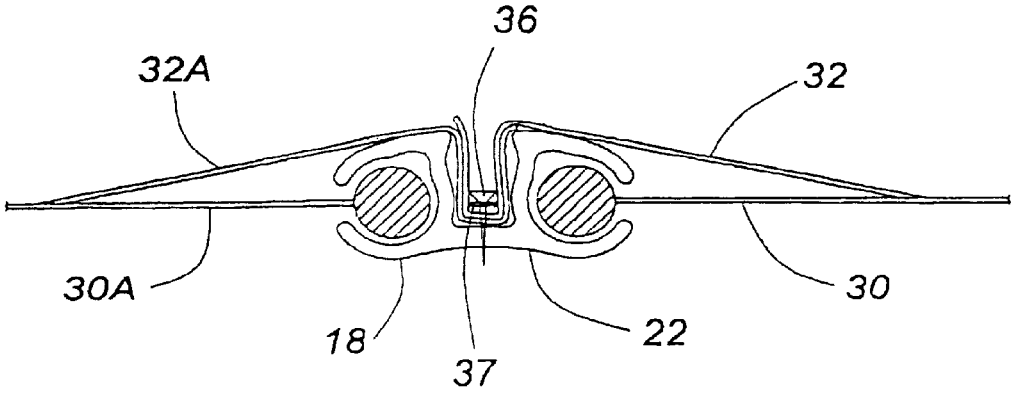
FIG. 12 is a cross-section view illustrating use of a screw to secure the flaps in the connecting member.

FIG. 12 shows another variation in which fabric flaps 32 and 32A are held in position by a self-tapping screw 36 and washers 37 on the screw. Plug 34 is then not required, but a sealing plug or cap may be added for cosmetic purposes.

Figure 13:
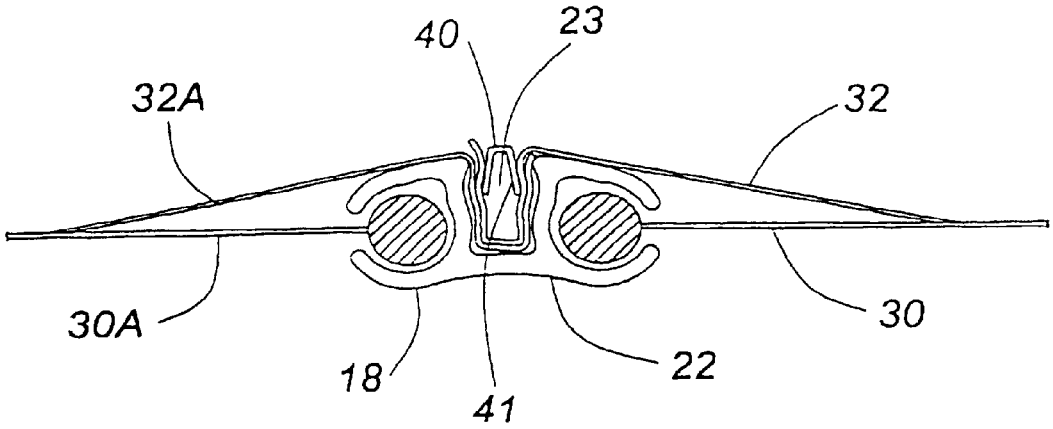
FIG. 13 is a cross-sectional view illustrating the use of a spring clip to secure the flaps in the connecting member.

In FIG. 13, a spring clip 40 is used instead of plug 34. The spring clip includes arms 41 which fit the undercut recess 23.

Figure 14:
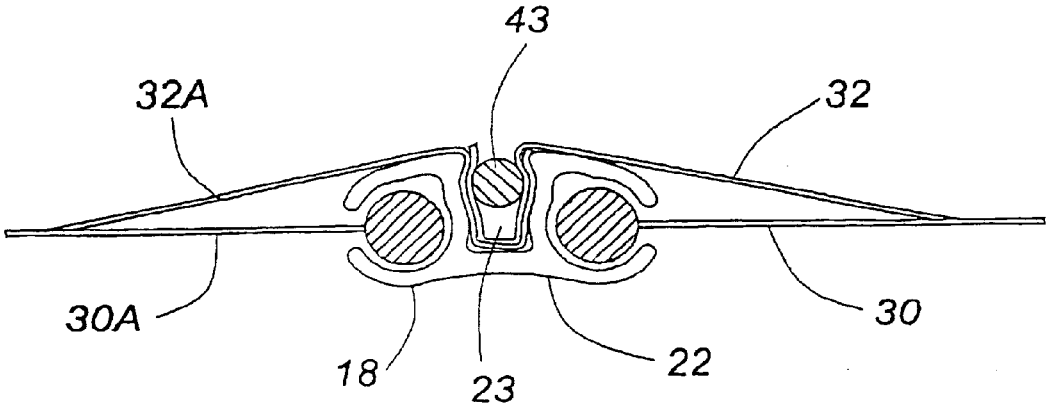
FIG. 14 illustrates the use of a pulled-in keder rope to secure the flaps in the connecting member.

FIG. 14 illustrates the use of a continuous pulled-in rope plug 43 fitting snugly within undercut channel 23 to hold flaps 32 and 32A in position, instead of plug 34.

Other variations within the scope of the appended claims may be used, as apparent to a person skilled in the art. The terms and expressions which have been employed in this disclosure are used as terms of description, and not of limitation, and there is no intention in the use of such terms and expressions to exclude equivalents of the features shown or described.

We claim:

1. A building structure comprising:

a. a plurality of arch members;

b. panels connected between said arch members, each of the panels comprising linear sheets of flexible material having means for attachment at each side margin and a flap of flexible material joined to said sheets adjacent to, but spaced from, the side margins of said sheets;

c. connecting members, comprising means for slidably engaging said means for attachment, a channel to receive said flaps and means for securing said flaps in the channel.

2. A building structure as in claim 1 in which the connecting member is mounted on and attached to said arch member.

3. A building structure as in claim 1 in which the flexible material of the sheets is a fabric.

4. A building structure as in claim 3 in which the flexible material of the flap is a fabric.

5. A building structure as in claim 1 in which the means for attachment at the side margins of the sheets of flexible material comprise keder ropes.

6. A building structure as in claim 5 in which the connecting member is a keder strip which comprises oppositely facing c-shaped sections, slidably to engage the keder ropes.

7. A building structure as in claim 6 in which the keder strip has an offset bottom web connecting said c-shaped sections so that said channel is defined by central portions of said c-shaped sections and said bottom web.

8. A building structure as in claim 7 in which the throat of said channel is narrower than its widest part.

9. A building structure as in claim 8 in which the means for securing the flaps in the channel comprises an elongated compressible plug.

10. A building structure as in claim 8 in which the means for securing the flaps in the channel comprises a spring clip.

11. A building structure as in claim 8 in which the means for securing the flaps in the channel comprises a screw.

12. A building structure as in claim 8 in which the means for securing the flaps in the channel comprises a keder rope slidable within the channel.

13. A connecting member for connecting keder ropes at the sides of flexible panels extending between frame members of a building structure and also for connecting flaps joined to the panels adjacent to, but spaced from the side margins of the panels, said connecting member is a keder strip which comprises oppositely-facing c-shaped sections slidably to engage the keder ropes, and an offset web connecting the c-shaped sections so that a channel within which the flaps may be secured is defined by central portions of the c-shaped sections and said web.

14. A connecting member as claimed in claim 13 in which the throat of the channel is narrower than its widest part to retain means for securing the flaps in the channel.

15. A panel to extend between connecting members on frame members of a building structure, said panel comprising a sheet of flexible material, a keder rope secured to each side margin of the sheet and adapted slidably to engage the connecting member and a flap of flexible material joined to said sheet adjacent to, but spaced from the side margins of the sheet, said flaps being adapted to be secured to said connecting members.

16. A panel as in claim 15 in which the flexible material of the panel is fabric.

17. A panel as in claim 16 in which the flexible material of the flap is fabric.

18. A method for making a building structure with a weather-tight seal comprising:

a. erecting a plurality of spaced arch members;

b. mounting a connecting member on the arch members, said connecting member having oppositely facing c-shaped sections connected with a web to define a channel between the c-shaped sections;

c. attaching panels to said connecting members, said panels comprising flexible sheets with keder ropes secured to each side margin of the sheets and said panels comprising flexible flaps joined to the sheets adjacent to but spaced from side margins of said sheets, the panels being attached by sliding the keder ropes within the c-shaped sections;

d. folding the flaps into said channel;

e. inserting a retaining member in said channel to secure the flaps.

19. A method as in claim 18 in which the channel has a throat narrower than its widest dimension and the retaining member is a rope plug.

20. A method as in claim 18 in which the channel has a throat narrower than its widest dimension and the retaining member is a rope of a diameter greater than that of the throat, slidable within the channel.

* * * * *